United States Patent [19]

John et al.

[11] Patent Number: 4,998,475

[45] Date of Patent: Mar. 12, 1991

[54] COMPACT PRINTING MACHINE INKER SYSTEM

[75] Inventors: Thomas John; Georg Bock; Rainer Burger, all of Augsburg; Franz X. Gollinger, Hirschbach, all of Fed. Rep. of Germany

[73] Assignee: Man Roland Druckmaschinen AG, Offenbach am Main, Fed. Rep. of Germany

[21] Appl. No.: 403,754

[22] Filed: Sep. 6, 1989

[30] Foreign Application Priority Data

Sep. 22, 1988 [DE] Fed. Rep. of Germany ..... 3832148
Sep. 22, 1988 [DE] Fed. Rep. of Germany ..... 3832183

[51] Int. Cl.[5] ..... B41F 31/08; B41F 27/10
[52] U.S. Cl. ..... 101/366
[58] Field of Search ..... 101/366, 363, 350, 207, 101/208-210

[56] References Cited

U.S. PATENT DOCUMENTS

| | | | |
|---|---|---|---|
| 1,137,856 | 5/1915 | Halliwell . | |
| 3,099,211 | 7/1963 | Hilgoe et al. | 101/366 X |
| 4,373,443 | 2/1983 | Matalia . | |
| 4,535,693 | 8/1985 | Belvederi | 101/366 |

FOREIGN PATENT DOCUMENTS

| | | |
|---|---|---|
| 1229108 | 11/1966 | Fed. Rep. of Germany . |
| 3326228 | 3/1984 | Fed. Rep. of Germany . |
| 3505598 | 4/1986 | Fed. Rep. of Germany . |
| 8507397 | 8/1987 | Fed. Rep. of Germany . |
| 3704433 | 8/1988 | Fed. Rep. of Germany . |
| 2074097 | 10/1981 | United Kingdom . |

OTHER PUBLICATIONS

Publication "Der Polygraph" 13-88 (The Polygraph), pp. 1102 and 1103, article by Josef-Peter Schramm: Gehört . . . die Zukunft, Verfahrensvergleich . . . (Does the Future Belong to Compact Inkers, Comparison between Offset and Offset-Anilox Methods).

*Primary Examiner*—J. Reed Fisher
*Attorney, Agent, or Firm*—Frishauf, Holtz, Goodman & Woodward

[57] ABSTRACT

The inker includes a chambered doctor blade unit (1) which defines an ink retention chamber. The ink retention chamber has an ink retaining ridge or strip (33) which extends from an upper surface towards the lower surface leaving a narrow ink passage gap (1') between the lower surface and the lower edge of the ridge or strip so that, upon selective connection of the unit (1) through a releasable coupling connection (5) of ink from a primary ink supply (3) or from a secondary ink supply (24, 40) of ink capacity substantially less than the ink capacity of the primary ink supply, ink within the ink retention chamber can be expelled under pressure being applied into said chamber, for example by compressed air, or sucked back into the cartridge. The cartridge permits application of a small quantity of ink, for example of different color than that of the primary ink supply, without disassembly of the entire inker. The compact inker formed by the doctor blade unit and the ink supply unit can readily be severed from the printing machine as a unitary group by disengaging a severable clutch (20), for example a claw clutch, provided to drive pumps (22) in the ink supply from a drive shaft (16, 531) common to a plurality of ink supply units and chambered doctor blade units, for example located axially adjacent each other along the anilox roller (6). The ink supply units have upwardly open troughs to catch ink being stripped off the anilox roller.

26 Claims, 7 Drawing Sheets

COMPACT PRINTING MACHINE INKER SYSTEM

Reference to related applications, assigned to the assignee of the present application, the disclosures of which are hereby incorporated by reference: U.S. Ser. No. 07/403,760 filed Sept. 6, 1989, BOCK et al now U.S. Pat. No. 4,938,133 U.S. Ser. No. 07/403,620, filed Sept. 6, 1989, BOCK et al.

REFERENCE TO RELATED PUBLICATIONS

German Patent Disclosure Document DE 33 26 228, BELVEDERI German Published Application 1 229 108, HILGOE et al.

Publication "Der Polygraph" 13-88, pp 1102 and 1103, ("The Polygraph"), article by Josef-Peter Schramm "Gehört den Kurzfarbwerken bei der Zeitungsherstellung die Zukunft?" "Verfahrensvergleich Offset gegenüber Offset-Anilox" ("Does the Future Belong to Compact Inkers"? "Comparison between Offset and Offset-Anilox Methods").

REFERENCE TO RELATED LITERATURE

"Technik des Flexodrucks" ("Technology of Flexography"), Coating Verlag Thomas & Co., publishers.

FIELD OF THE INVENTION

The present invention relates to an inker system for printing machines and more particularly to a compact inker for any type of printing machine, especially for offset or flexography type machines, and having a doctor blade to strip ink off an anilox roller located adjacent an ink application chamber. Such inkers are known as chambered doctor blade inkers. Ink is supplied to such inker through an ink supply duct.

BACKGROUND

It is sometimes desirable to be able to change ink being supplied to an inker, for example to change the color thereof. For some printing jobs, the situation arises in that only a very small quantity of ink having a color different from that normally supplied to the inker may be required. To handle such printing jobs, it is uneconomical to completely exchange the entire inker mechanism, including an ink supply trough, connecting lines between the ink supply trough and the ink application chamber adjacent the doctor blade, and the like, merely to be able to apply a small quantity of ink of a different color for a specific purpose.

THE INVENTION

It is an object to provide an inker which is so constructed that if only a small quantity of ink is required for a specific printing job this small quantity can be supplied with a minimum loss of ink, and which can be easily disassembled.

Briefly, a secondary ink supply, preferably in form of a cartridge, and having an ink capacity substantially less than the ink capacity of the primary supply, is provided. The secondary ink supply being pressurized, for example by compressed air, and connectable to the ink supply chamber via a releasable coupling, disconnecting the coupling from the primary ink supply and replacing it with a connection to the secondary ink supply. The structure includes a doctor blade and an ink retention chamber. The ink retention chamber is, preferably, so constructed that it includes an ink retaining ridge or strip which extends from an upper surface of the ink retention chamber towards the lower surface thereof, leaving a narrow ink passage gap between the lower edge of the ridge of strip and the facing surface of the ink retention chamber.

In accordance with a feature of the invention, and in order to permit ready removal of a chambered doctor blade unit from the machine as well as an associated ink supply arrangement including a centrally powered ink pump, the drive arrangement for the ink pump includes a severable clutch, such as a claw clutch, a holding or grabbing spring clutch or the like.

DRAWINGS

DETAILED DESCRIPTION

Figure 1:
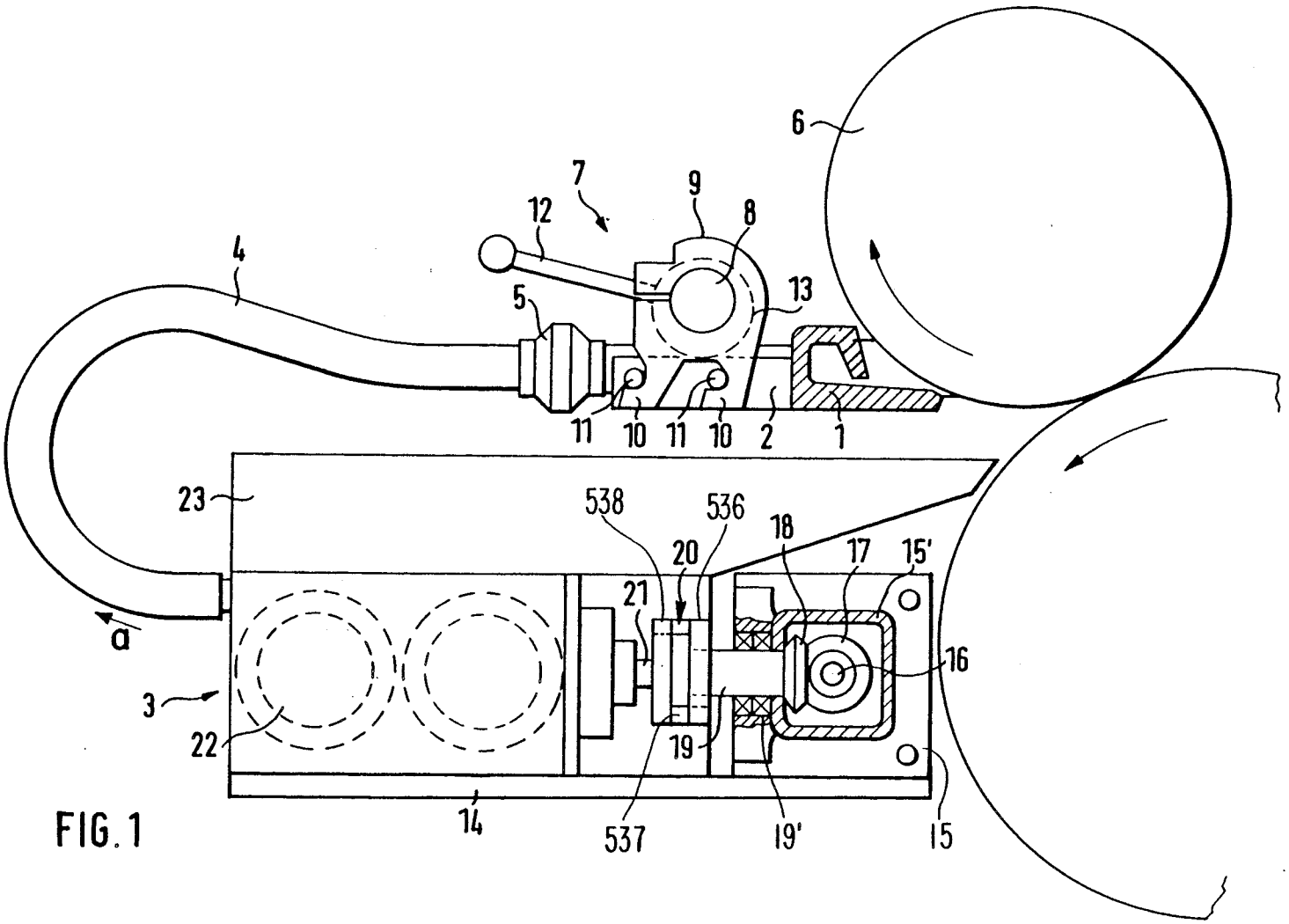
FIG. 1 is a schematic side view of a flexographic-type inker in accordance with the present invention, and showing connection of the inker to a primary ink supply.

The compact inker, see FIG. 1, uses an ink supply having a doctor blade which is part of an ink application chamber For economy of description, this structure 1, shown in cross section in FIG. 1, will be referred to as a "chambered doctor blade unit". The chambered doctor blade unit 1 is secured to a support carrier 2 and coupled to an ink supply system 3 via a flexible ink duct 4. One end of the ink duct 4 is connected to the carrier 2 by a releasable coupling, for a union, bayonot coupling or the like. The other end of the duct 4 can be securely connected to the ink supply 3 or, if desired, also connected thereto by a union or releasable coupling 5. The chambered doctor blade unit 1 supplies ink to an anilox roller. Unit 1 is also known as a doctor blade ink chamber.

A holder structure 7 is provided to retain the chambered doctor blade unit 1 in properly aligned relationship with respect to the anilox roller 6. The holder 7 is secured to a cross rod 8 which is rotatably secured at its respective ends in the side walls of a printing machine. The holder 7 includes two spaced holder elements 9, which are formed with two hook-like extensions or projections 10 into which two bolts 11, secured to the carrier 2 holding the chambered blade unit 1 can be hooked. Besides the holder 9, and for example adjacent thereto, a rotatable eccentric 13 is located on the cross rod 8, which can be twisted by the hand lever 12, and which acts on the upper surface of the support 2 and thus can engage the bolts 11 in fixed and unmovable abutment on the hook-like extensions 10. Copending application U.S. Ser. No. 07/403,760, filed Sept. 6, 1989, BOCK et al now U.S. Pat. No. 4,938,133, describes the details of this attachment.

A further support is provided below the lower edge of the anilox roller, which includes a cross support 15, and a carrier plate 14. The cross support 15', for example, includes a box-like projecting rail 15', extending axially parallel to the anilox roller 6. The carrier plate 14 as well as the cross support 15 are connected at their respective ends to the side walls of the printing machine. The carrier plate 14 holds and supports the ink supply device 3; the cross element 16 provides a support and cover for a main shaft 16 which, via bevel gears 17, 18, drives a shaft 19. The driven shaft 19 is coupled by a releasable coupling 20, for example a claw clutch, with a drive shaft 21 for an ink supply pump 22 of the ink supply system 3. An ink trough 23 retains ink for use in the printing system and for application to a printed substrate.

The arrangement permits printing on substantial surfaces of substrates and is designed for and intended to hold a substantial quantity of ink.

Some printing jobs require ink of a different characteristic than that which is normally retained in the trough 23, for example ink of a different color, but only in small quantities since the differently colored ink will be used only on small surfaces.

Figure 2:
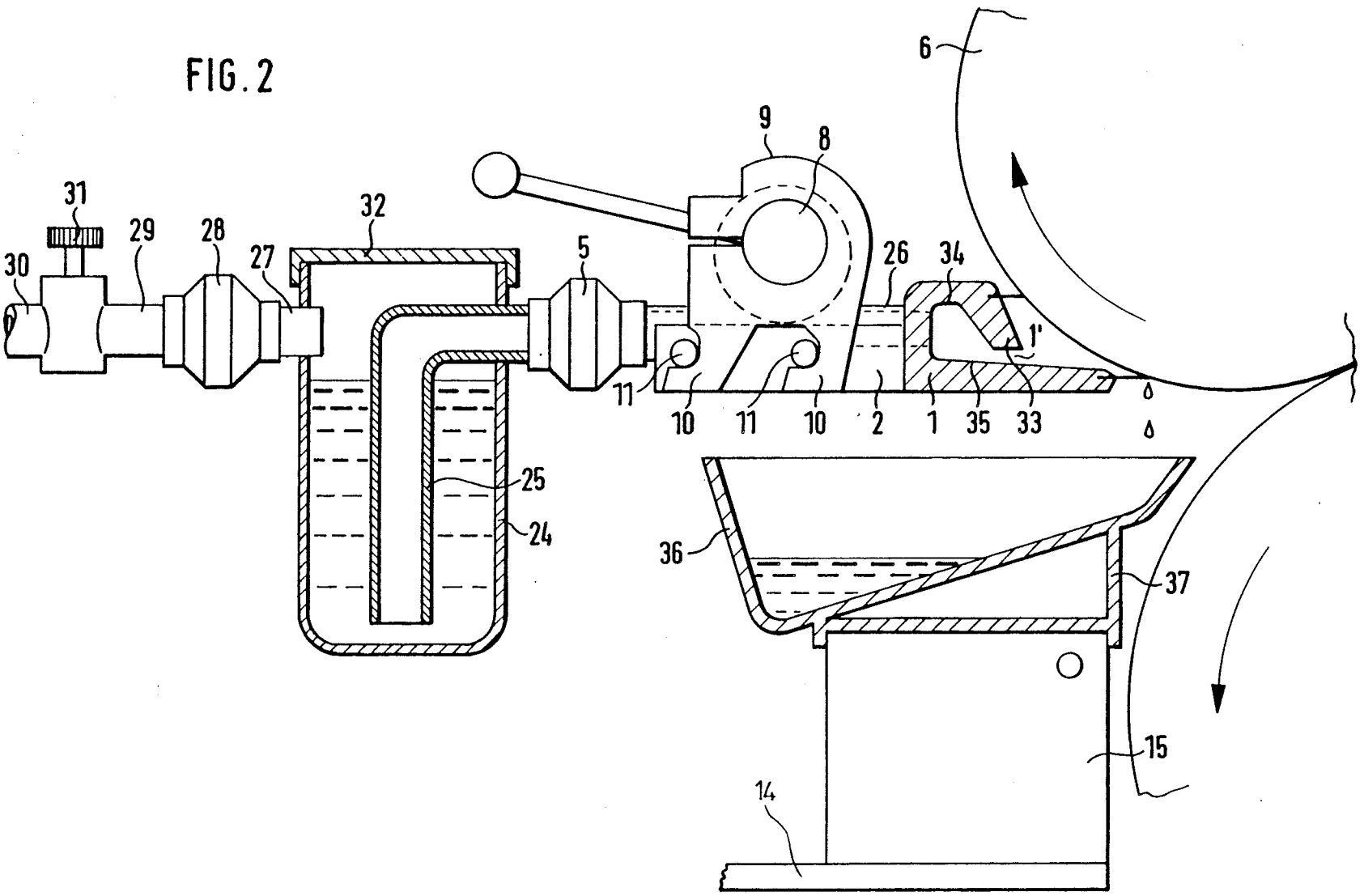
FIG. 2 is a view similar to FIG. 1 illustrating connection to a secondary ink supply, in which the secondary ink supply is in form of a cartridge.

Referring now to FIG. 2: In accordance with a feature of the invention, an ink cartridge 24 can be coupled to the chambered doctor blade unit 1 by the releasable coupling 5. The cartridge 24 has a riser tube 25 therein which terminates in a coupling element compatible with the union or releasable coupling 5 for supply of ink to the chamber formed by the chambered doctor blade unit 1 through a supply tube 26. A stub 27 terminates in the cartridge 24, to which one portion of a releasable coupling 28 is connected. The other portion of the releasable coupling 28 is connected to a compressed air supply line 29 which, at least in part, is flexible. A throttle valve 30 is located in a compressed air line 29. The throttling effect is adjustable by a hand wheel 31. A cover 32 closes off the cartridge 24. Preferably, the cover 32 is threaded on the cartridge 24 so that the cartridge 24 can be resupplied with ink when it is empty or about empty.

In accordance with a feature of the invention, the chambered doctor blade unit 1 is formed with an upper portion 34 from which a dependent rib or strip 33 extends downwardly towards the upper surface of the lower portion 35. The chamber of the chambered doctor blade unit 1 is defined between the lower surface of the upper portion 34 and the upper surface of the lower extending portion 33. The chamber extends axially parallel to the axis of the anilox roller 6 throughout the entire axial extent thereof. A small gap 1' is formed between the lower end of the ridge or rib 33 and the upper surface of the lower portion 35

In accordance with another feature of the invention, an ink catch trough 36 is provided which, if the inker 3 is removed, can be seated on the cross element 15 to catch ink from the cartridge 24 and dripping off the anilox roller. The trough 36 extends axially along the length of the anilox roller 6 and is held on the cross element 15 by rib-legs 37. Alternatively, the trough 36 can be releasably secured to the holder plate 2 and/or the chambered doctor blade unit 1, for example by being suspended therefrom.

OPERATION

If it is desired to print subject matter requiring only very little ink, the union 5 (FIG. 1) is released and the ink supply unit 3 taken off the carrier plate 14. The drip trough 36 (FIG. 2) is then seated on the cross element 15, and the ink cartridge 24 is coupled to the chamber doctor blade unit 1 via the coupling 5. The ink cartridge 24 is then pressurized by connecting coupling 28 to the compressed air supply line 29. Upon application of compressed air, ink is forced through the riser tube 25 and connecting tube 26 into the chamber formed by the chambered doctor blade unit 1, so that ink is applied to the anilox roller 6. Ink dripping off the anilox roller is caught in the catch trough 36.

If the level of ink within the cartridge 24 drops below the lower edge of the riser tube 25, compressed air is supplied directly through the riser tube 25 and pipe 26 into the chamber of the chambered doctor blade unit 1. The depending strip or rib 33 ensures that then at least a portion of the ink still within the chamber of the chambered doctor blade unit 1 is applied to the anilox roller 6. This supply of residual ink will continue until the level of ink in the chamber between the outlet of the tube 26 and the rib 33 reaches the lower edge of the rib 33. Thus, any ink from the cartridge 24 is utilized to the fullest with practically no waste.

The connecting tube 26, as best seen in FIG. 1, terminates at an upper region of the chamber formed in the chambered doctor blade unit 1.

Figure 3:
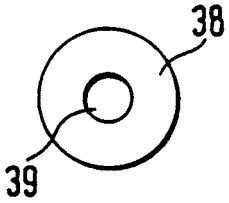
FIG. 3 is a fragmentary detail view of another embodiment of the arrangement of FIG. 2.

Controlling the pressure of compressed air to the cartridge 24 by the valve 30, 31 permits ready control of the quantity of ink being supplied. Rather than using an adjustable valve 30, it may be sufficient in certain installations to merely introduce a metering washer 38 (FIG. 3) having a specifically dimensioned opening 39 therein in line 29 or into line 26 or coupling 5, in which the opening 39 is suitably dimensioned to effect the necessary throttling of ink supply.

Figure 4:
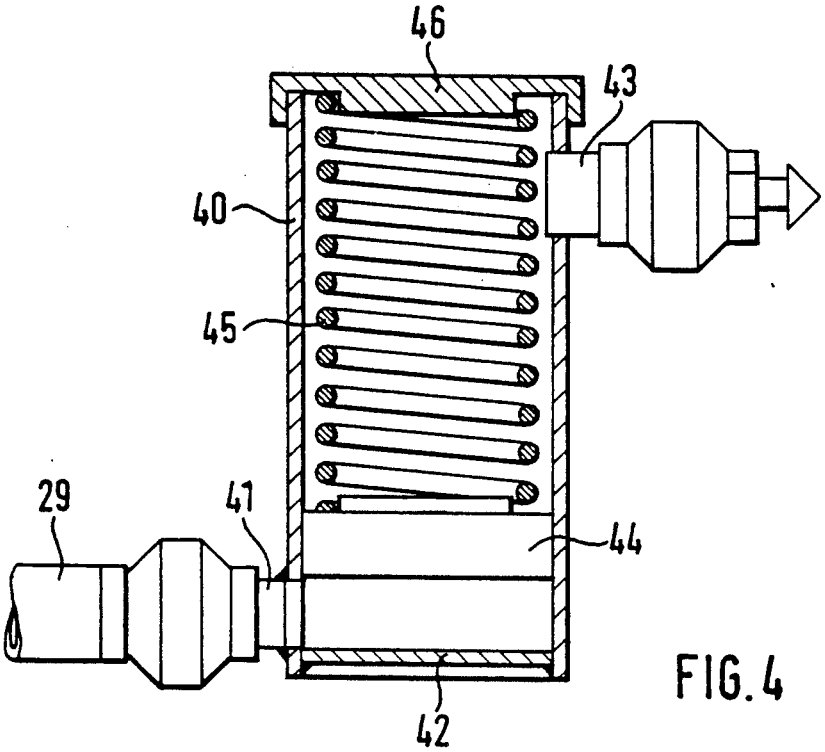
FIG. 4 is a vertical cross section through another form of an ink supply cartridge to form the secondary ink supply.

FIG. 4 illustrates a further embodiment of the invention in which an ink cartridge 40 is used, having a supply stub 41 for compressed air, terminating at the bottom of the cartridge, immediately above the bottom wall 42 thereof. A further stub 43, adapted to be coupled to the coupling 5, is located in the upper region of the cartridge 40. A piston 44 is located within the cartridge, sealed against the inner surfaces of the walls thereof, and pressurized by a compression spring 45, the other end of which engages against the cover 46 of the cartridge 40. Ink is located in the region above the piston 44. The stubs 41, 43 project somewhat inwardly of the walls of the cartridge 40 to limit the travel of the piston 44.

Upon pressurizing the piston 44 with compressed air through line 29, piston 44 will supply ink by pressurizing the ink and also stress the spring 45. This arrangement prevents blowing of compressed air into the chambered doctor blade unit 1. Residual ink which is no longer used for printing, or cannot be used for printing, will be somewhat greater than in the arrangement in accordance with FIG. 2. This ink, however, is returned to the cartridge 40. Upon disconnecting compressed air from line 29, the spring 45 will move the piston 44 downwardly, which places suction on the ink supply line to suck back the ink within the chamber of the chambered doctor blade unit 1 and such ink as may still have been in the connecting line 26, and the coupling 5.

Figure 5:
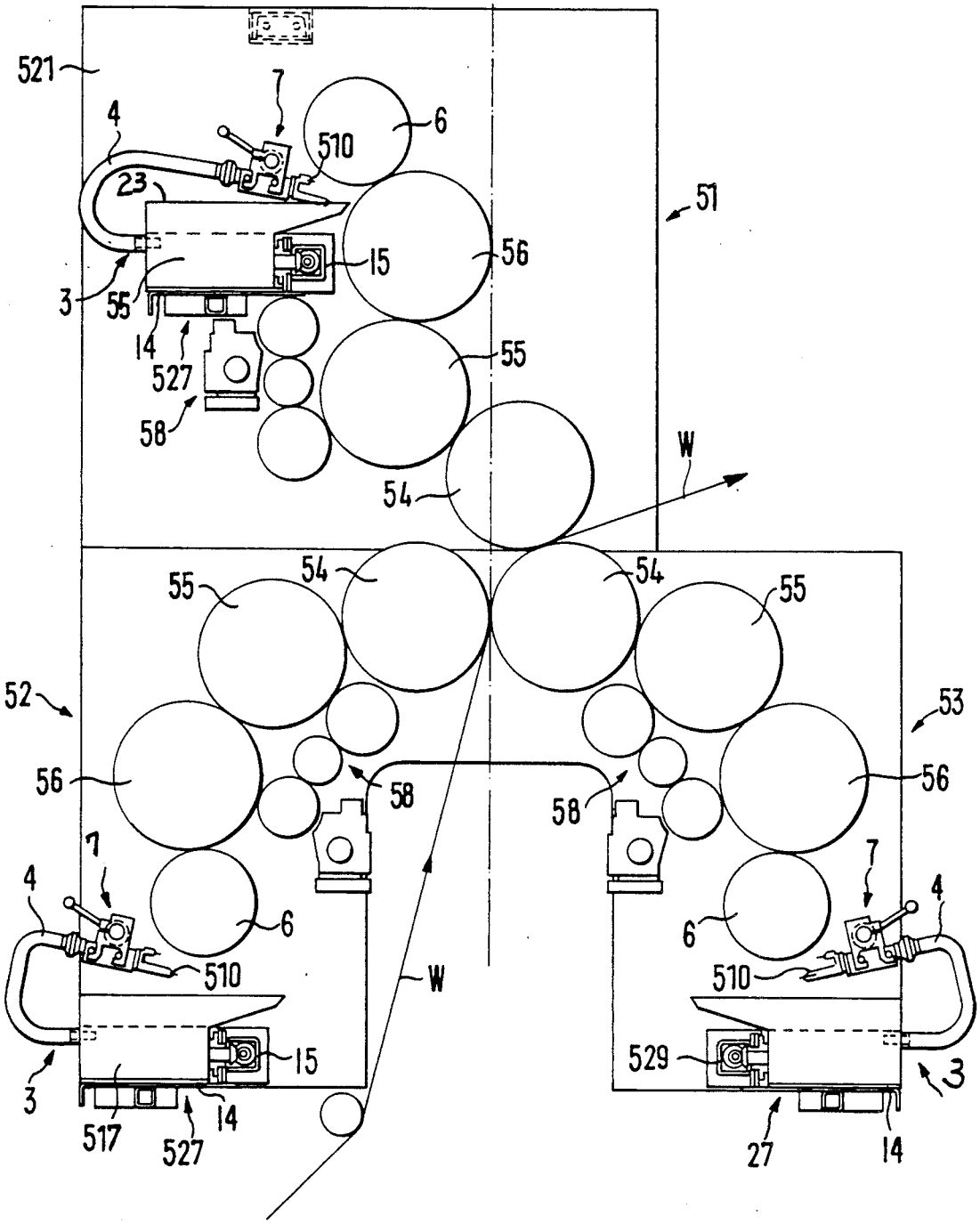
FIG. 5 is a schematic side view of a printing machine having three printing units and embodying the present invention.
Figure 6:
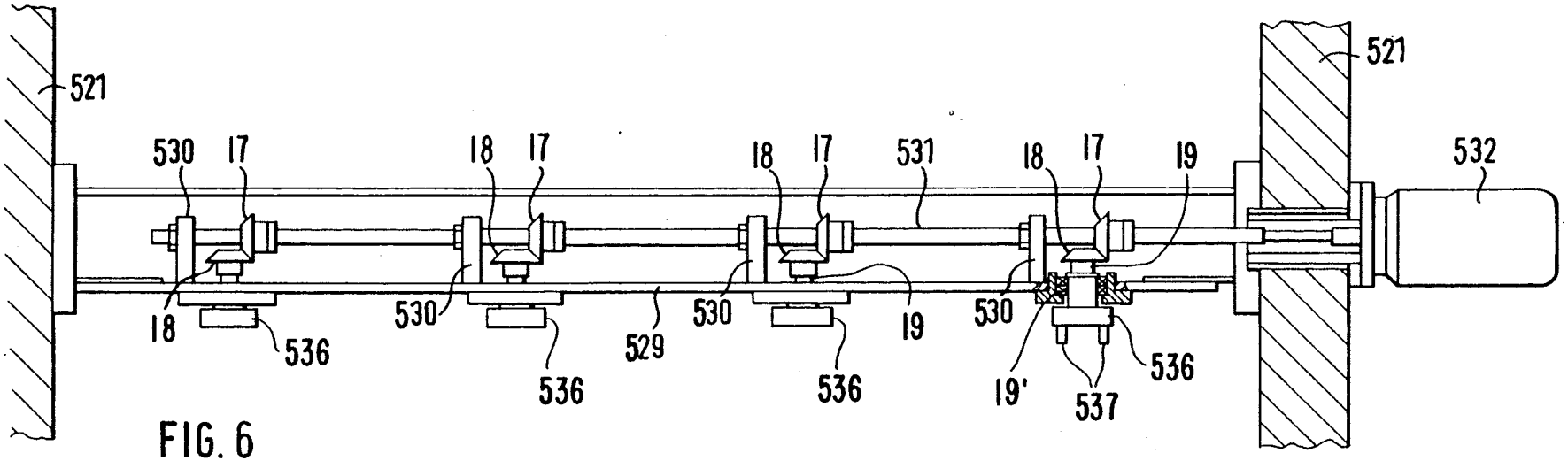
FIG. 6 is a front view of a holder for the ink supply system.
Figure 7:
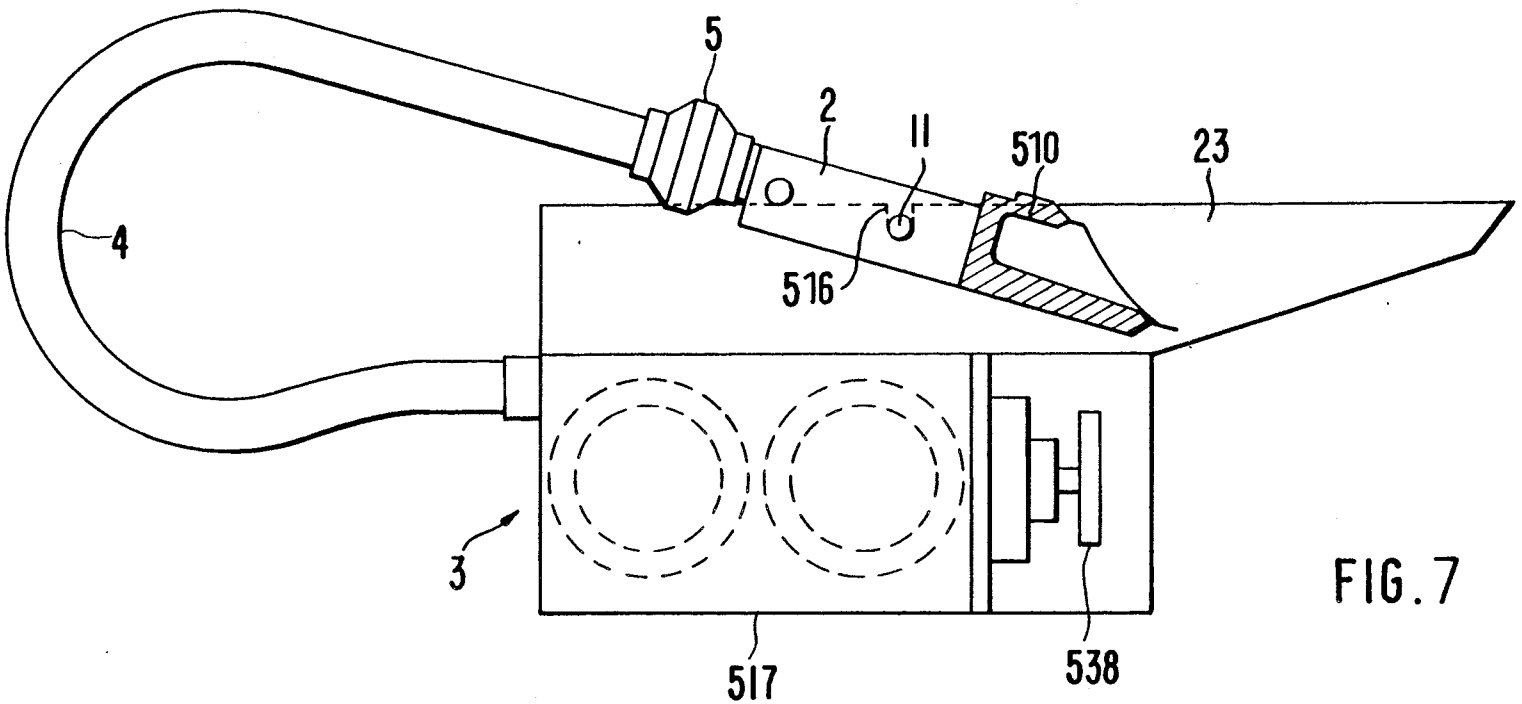
FIG. 7 is a side view of the inker in transport position.

Referring now to FIGS. 5 through 7: The printing machine, suitable for the ink-selective inker described in connection with FIGS. 1–4, has three printing units 51, 52, 53. Each one of the printing units includes a blanket cylinder 54, a plate cylinder 55, an ink application roller or cylinder 56 and an anilox roller 6, which is the type of roller described in connection with FIG. 1. Each one of the printing systems 51, 52, 53 includes a damper 58, associated with the respective plate cylinder 55. The ink supply systems 3 supply ink to the chambered doctor blade units 1 which are shown schematically only at 510 in FIG. 5. All the ink supply units 3 are identical. They can be, selectively, coupled by the hydraulic coupling 5 (FIG. 1) or to the cartridge supply as explained in connection with FIGS. 1 and 2.

A substrate web W is guided over suitable guide rollers through nips between the blanket cylinders 54, as best seen in FIG. 5.

The ink supply units each have a catch trough 23 (FIGS. 1, 7) open at the top. Troughs 23 are formed with a short slit 516 at the side wall thereof (FIG. 7). A pump unit 517 is located below the trough 23. The pump unit has a drive shaft 21 (FIG. 1) which projects from the housing for the pump 517.

The holders 7 for the chambered doctor blade unit 510 are identical to those described in connection with FIGS. 1 and 2.

The holding arrangement for the ink supply is identical to that previously described. Beneath each one of the anilox rollers 6, a holding system 527 is provided which includes the carrier plate 14 as well as a cross element 15. The cross element 15 as well as the carrier plate 14 extend transversely across the printing machine, and is secured to the side walls 521 thereof (see FIG. 6). The cross element 15, as best seen in FIG. 6, supports a plurality of bearings 530 which, in turn, rotatably support a main shaft 531. One end of the main shaft 531 passes through the side wall 521 and is securely coupled to a drive motor 532. The main shaft 531 includes a plurality of bevel gear pairs 17, 18 which, in turn, are coupled to a drive shaft 19 (FIG. 1). The distribution gearing includes a plurality of bevel gears 17, seated on the main shaft 531, which corresponds to shaft 16 of FIG. 1, which mesh with matching bevel gears 18 which, in turn, are coupled to the shafts 19. Shafts 19 are rotatably secured to the cross element 15 by suitable bearings 19'.

In accordance with a feature of the invention, the driven shafts 19 and the shaft 21 of the pumps of the inking units are releasably and severably coupled by a releasable clutch 20. The releasable clutch 20 has a first clutch part 536 with claws 537 thereon, which interengage between the spaces of claws formed on a counter clutch part 538 and connected to the shaft 21 of the pump (FIGS. 1, 7).

FIG. 6 illustrates a cross element 529 arranged for a printing machine carrying four chambered doctor blade units 510 axially adjacent each other. Accordingly, the cross element 8 (FIGS. 1, 2) likewise has a four holder systems 7 located adjacent each other. Of course, the machine can be designed for only a single chambered doctor blade unit, extending over the full axial length of the anilox cylinder 7, or for any other desired number of chambered doctor blade units, positioned adjacent each other, or with gaps therebetween.

REMOVAL AND EXCHANGE OF AN INKER SYSTEM

If one of the inker units 3 is to be removed, or exchanged for another one carrying different color ink, or is to be uncoupled by the releasable coupling 5 for connection of the doctor blade unit 1 to an ink cartridge, the unit 3 can be Pulled out rearwardly by itself in the direction of the arrow a (FIG. 1).This releases the clutch part 538 from the clutch part 536.

If it is desired to remove the chambered doctor blade unit 510 and the inker unit 3 together as a unit, for example to replace the entire unit, and leaving the coupling 5 connected, the lever 12 is operated to release the chambered doctor blade unit and unclamp it from the holder shaft 8. This permits engaging one of the bolts or pins or stubs 11, preferably the leading pin or stub originally closest to the anilox roller 6, in the slits 516 of the side wall of the ink trough 23, to assume the position shown in FIG. 7. The entire inker unit can then be placed on a shelf or other suitable support, for later use, cleaning or the like.

To insert a new inker 3 at the now free position, the ink supply unit 12 is first moved counter the direction of the arrow a (FIG. 1), and seated on the carrier plate 14 of the cross element 15 until the respective counter-facing claws of the clutch halves 536, 538 interengage. Thereafter, the carrier 2 for the chambered doctor blade unit 510 is secured by hooking the bolts or pins or stubs 11 in the respective hook-like extensions 10 of the holder 9 and the eccenter 13 operated by rotating the lever 12. Preferably, and to provide for ease of use and assembly and disassembly, the entire cross unit 15 could be rotatable with respect to the side walls of the printing machine by an angle of between about 15° to 30°; when connecting and disconnecting the bolts 11 from the hook-like projections 10, then, the doctor blades themselves will be lifted off engagement from the anilox roller 6. This tilting arrangement is described in detail in the cross referenced application U.S. Ser. No. 07/403,760, filed Sept. 6, 1989, BOCK et al now U.S. Pat. No. 4,938,133.

Locating the ink trough 23 in a plane beneath the anilox roller 7 has the additional advantage that ink, which is stripped off the anilox roller 6 by the lower doctor blade can drip down immediately into the ink trough 23, for reuse and pumping by the pumps 22 within the ink supply unit 3.

Various changes and modifications may be made, and, for example, the claw clutch described can be replaced by different types of completely severable clutches. For example, an electromagnetic clutch can be used; or a grabbing or spiral-type spring clutch.

Figure 8:
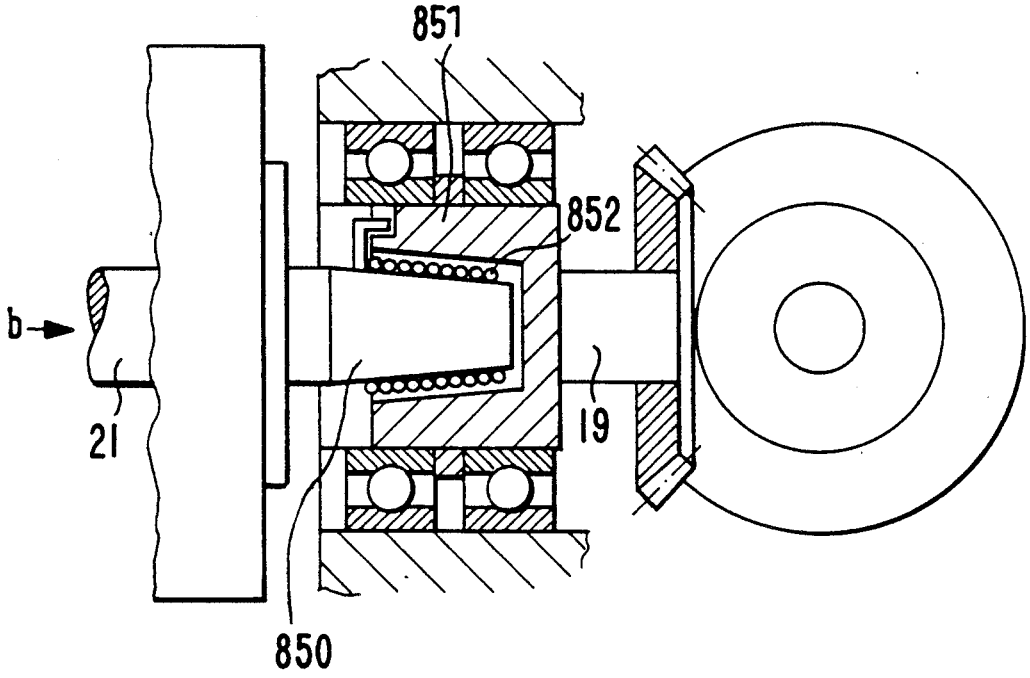
FIG. 8 is a schematic side view, partly in section, of an alternative clutch arrangement.

FIG. 8 shows such a grabbing spring-type of clutch in which the drive shaft 21 is formed with a terminal cone 850, forming one clutch part. The other clutch part 851 is formed by a bushing securely seated on the shaft 19. The bushing has a conically tapering inner wall surface. A conically wound spiral spring 52 is secured in the bushing with one end thereof, to rotate therewith.

To engage the clutch, the shaft 21 is pushed in the direction of the arrow b until the spring 52 tightly engages on the conical outer surface of the conical stub 850.

In this arrangement it is necessary to lock the ink supply unit 3 in position on the carrier plate 14 of the cross member 15 by a suitable latch, movable bolt or the like. Such a latch or movable bolt is desirable in any event for secure attachment of the inker on the support plate 14.

Various changes and modifications may be made and any features described herein may be used with any of the others, within the scope of the inventive concept.

What is claimed is:

1. Printing machine inker to supply ink to an ink accepting roller (6) having means (1, 7) for applying ink to the ink accepting roller;

a primary ink supply (3), a connecting line (4) coupling the primary ink supply (3) to the ink applying means (7, 1) and comprising a secondary ink supply (24, 40) having an ink capacity substantially less than the ink capacity of the primary ink supply;

means (27–30; 29–46) for applying pressure to ink in said secondary ink supply;

a releasable coupling connection (5) connected to said ink applying means (7, 1) and selectively connectable to said secondary ink supply (24, 40) or to said connecting line (4) from said primary ink supply (3);

and wherein said means (7, 1) for applying the ink to said ink accepting roller (6) comprises a chambered doctor blade unit (1, 510) defining an ink retention chamber; and wherein said ink retention chamber is in fluid communication (26) with said releasable coupling connection (5) for selectively connecting ink from said primary ink supply (3) through said connecting line (4) or from said secondary ink supply (24, 40) to the ink retention chamber of said chambered doctor blade unit (1, 510).

2. The inker of claim 1, wherein said chambered doctor blade unit (1) comprises an ink retaining ridge or strip (33) extending from an upper surface of the ink retention chamber towards a lower surface thereof and terminating in a bottom edge, leaving a narrow ink passage gap (1') between said lower surface and the bottom edge of said ridge or strip (33).

3. The inker of claim 1, wherein said secondary ink supply comprises an ink cartridge unit (29, 40) and said means for applying pressure to ink in said cartridge unit comprises a compressed air connection (29).

4. The inker of claim 3, further including a riser pipe (25) located within said cartridge and extending from an upper region thereof towards a lower region said cartridge;

and wherein said compressed air connection terminates in said cartridge in an upper region thereof.

5. The inker of claim 1, wherein said secondary ink supply comprises a replaceable ink supplying cartridge (29, 40);

and throttling means (30; 38) are provided, controlling the pressure of ink from said cartridge being conducted through said releasable coupling means (5) to the ink retention chamber in said chambered doctor blade unit (1).

6. The inker of claim 1, wherein said means for applying pressure comprises compressed air, and a controllable throttling valve (30) is provided located in a compressed air supply.

7. The inker of claim 5, wherein said means for applying pressure to ink in the cartridge comprises compressed air;

and wherein the throttling means comprises a throttling washer (38) having a fluid passage opening (39) therein located in at least one of:

the ink supply connection from said cartridge (24, 40) to the ink retention chamber;

the compressed air connection (29) to the cartridge.

8. The inker of claim 1, further including a cross member (15) located beneath said chambered doctor blade unit (1) and extending axially parallel to said ink accepting roller (6);

and an ink drip pan (36) releasably and removably secured to said cross member (15), said cross member further including means (16–20) releasably engageable with said primary ink supply (3) for supplying ink from said primary ink supply through said connecting line and releasable coupling connection (5) to said chambered doctor blade unit (1).

9. The inker of claim 1, wherein (FIG. 4) said secondary ink supply comprises a cartridge (40) including a piston (44) therein;

spring means (45) located between said piston and an upper region of said cartridge, said upper region defining a secondary ink supply chamber;

and compressed air means (29) for pressurizing said piston and coupled to the cartridge beneath said piston and at the surface remote from said spring means (45).

10. The inker of claim 1, in combination with a printing machine having said ink accepting roller (6), wherein said primary ink supply includes an ink pump (22) having a pump shaft and said connecting line (4) coupling the ink pump to the chambered doctor blade unit (1, 510);

said ink applying means including releasable attachment means for releasably attaching the doctor blade unit on the printing machine;

support means (14, 15) located, at least in part, below the ink accepting roller (6) for releasably supporting the ink supply means on the printing machine below said roller; and a drive engagement (19, 20, 21) for the ink pump (22) including a drive shaft (16; 531) and a severable clutch (20) having two severable clutch parts (536, 538) coupling, respectively, said drive shaft (16; 531) and said pump shaft (21) for the pump and, selectively, permitting removal of said ink supply means from said printing machine upon severing of said severable clutch parts.

11. The inker of claim 10, further including an upwardly open ink trough or basin (23) forming part of said ink supply means (3) and positioned below the ink accepting roller (6) and located to catch ink dripping off the ink accepting roller and being stripped therefrom by a doctor blade of the chambered doctor blade unit.

12. The machine of claim 1, wherein said severable clutch (20) comprises a claw clutch.

13. The inker of claim 10, wherein said severable clutch comprises a spiral grab spring clutch (850–852).

14. The printing machine and inker of claim 10, further including plural ones of said inker, further including a plurality of distribution gear means (17, 18) coupled to said drive shaft (16, 531), each distribution gear means being coupled to an associated one of said clutch parts (536) for engagement with the other one of the clutch parts (538) for coupling to the respective pump shaft (21) of the respective pump (22) of a respective one of the plurality of inkers; and a common drive motor (532) driving said drive shaft.

15. The inker of claim 10, further including projecting bolts or stubs (11) extending from the chambered doctor blade unit (510);

hook-like holding means (10) engageable with said projecting bolts or stubs for holding the chambered doctor blade unit on the printing machine;

wherein said primary ink supply further includes an ink trough (23); and upwardly extending short slits (516) formed on the ink trough (23) for, selectively, receiving at least one of said projecting bolts or stubs (11), to permit removal of the inker from the printing machine and to permit retention of the chambered doctor blade unit (1, 510) in position on said primary ink supply (3).

16. Printing machine having an ink receiving roller (6) and at least one compact inker (1, 3) to supply ink to the ink accepting roller, wherein said compact inker comprises a chambered doctor blade unit (1, 510);

ink supply means (3) including an ink pump (22) having a pump shaft (21), and an ink connecting means (4) coupling the ink pump to the chambered doctor blade unit (1, 510);

releasable attachment means (7) for releasably attaching the doctor blade unit on the printing machine;

support means (14, 15) located, at least in part, below the ink accepting roller (6) for releasably supporting the ink supply means (3) on the printing machine and below said ink accepting roller (6); and a drive arrangement (19, 20, 21) for the ink pump (22) including a drive shaft (16; 531) and a severable clutch (20) having severable clutch parts (536, 538) coupling, respectively, said drive shaft (16, 531) and said pump shaft (21) for the pump (22).

17. The machine of claim 16, further including an upwardly open ink trough or basin (23) forming part of said ink supply means (3) and positioned below the ink accepting roller (6) and located to catch ink dripping off the ink accepting roller and being stripped therefrom by a doctor blade of the chambered doctor blade unit.

18. The machine of claim 16, further including a severable hydraulic coupling or union (5) connecting said ink connecting means and releasably severably coupling the ink pump (22) to the chambered doctor blade unit (1 ,510).

19. The machine of claim 16, wherein said severable clutch (20) comprises a claw clutch.

20. The machine of claim 16, wherein said severable clutch comprises a spiral grab spring clutch (850–852).

21. The printing machine and inker of claim 16, further including plural ones of said inker, further including a plurality of distribution gear means (17, 18) coupled to said drive shaft (16, 531), each distribution gear means being coupled to an associated one of said clutch parts (536) for engagement with the other one of the clutch parts (538) for coupling to the respective pump shaft (21) of the respective pump (22) of a respective one of the plurality of inkers; and a common drive motor (532) driving said drive shaft.

22. The combination of claim 21, wherein said distribution gear means comprises a bevel gearing.

23. The combination of claim 21, further including a plurality of driven shafts (19) coupled to said distribution gear means (16, 531) each driving a respective one of the pumps through a respective clutch.

24. The machine of claim 16, further including projecting bolts or pins (11) extending from the chambered doctor blade unit (510);

hook-like holding means (10) engageable with said projecting bolts or pins for holding the chambered doctor blade unit on the printing machine;

wherein said primary ink supply further includes an ink trough (23); and upwardly extending short slits (516) formed on the ink trough for, selectively, receiving at least one of said bolts (11), to permit removal of the compact inker (1, 3) from the printing machine and to permit retention of the chambered doctor blade unit (1, 510) in position on said ink supply means (3).

25. Printing machine inker to supply ink to an ink accepting roller (6) having means (1, 7) for applying ink to the ink accepting roller, said ink applying means comprising a chambered doctor blade unit (1, 510) defining an ink retention chamber;

a releasable coupling connection (5) for connecting ink to said ink retention chamber; and an ink supply coupled to said releasable coupling means, said ink supply comprising a housing (40) including a piston (44) therein;

spring means (45) located between said piston and an upper region of said housing, said upper region defining an ink supply chamber; and compressed air means (29) for pressurizing said piston and coupled to the housing beneath said piston and at a surface remote from said spring means (45), whereby, for supplying ink to said ink retention chamber, application of compressed air will push ink from said housing into said ink retention chamber, and upon release of air pressure, the spring means will push said piston in a direction to increase the volume of said ink supply chamber, and suck ink from the ink retention chamber back into said housing.

26. The inker of claim 25, wherein said chambered doctor blade unit (1) comprises an ink retaining ridge or strip (33) extending from an upper surface of the ink retention chamber towards a lower surface thereof and terminating in a bottom edge, leaving a narrow ink passage gap (1') between said lower surface and the bottom edge of said ridge or strip (33).

* * * * *